US006966074B2

(12) United States Patent
Huh

(10) Patent No.: US 6,966,074 B2
(45) Date of Patent: Nov. 22, 2005

(54) CUSHION PAD STRUCTURE FOR HEADBAND

(75) Inventor: Moon Young Huh, Seoul (KR)

(73) Assignee: Otos Tech Co., Ltd., Seoul (KR)

( * ) Notice: Subject to any disclaimer, the term of this patent is extended or adjusted under 35 U.S.C. 154(b) by 4 days.

(21) Appl. No.: 10/830,159

(22) Filed: Apr. 22, 2004

(65) Prior Publication Data

US 2005/0138719 A1 Jun. 30, 2005

(30) Foreign Application Priority Data

Apr. 29, 2003 (KR) ..... 20-2003-0013313

(51) Int. Cl.[7] ..... A42B 3/00
(52) U.S. Cl. ..... 2/414; 2/416; 2/267; 2/181.4; 2/DIG. 11
(58) Field of Search ..... 2/411, 412, 414, 2/415, 416, 420, 421, 267, 417, 418, 419, 2/909, 181.4, DIG. 11

(56) References Cited

U.S. PATENT DOCUMENTS 3,046,559 A * 7/1962 Cox et al. ..... 2/419
3,289,212 A * 12/1966 Morgan ..... 2/420
3,292,180 A * 12/1966 Marietta ..... 2/415
4,259,747 A * 4/1981 Taesler et al. ..... 2/422
4,675,919 A * 6/1987 Heine et al. ..... 2/410
4,884,301 A * 12/1989 Aileo ..... 2/421
5,025,504 A * 6/1991 Benston et al. ..... 2/181.4
5,474,487 A * 12/1995 Roush et al. ..... 2/267
5,926,849 A * 7/1999 Boyle ..... 2/181.8

* cited by examiner

*Primary Examiner*—Rodney M. Lindsey
(74) *Attorney, Agent, or Firm*—Jordan and Hamburg LLP

(57) ABSTRACT

Disclosed herein is a cushion pad structure, which is coupled to a headband as an integral component of safety hats, protective masks, and the like, so as to maintain the uniform balance of the headband, thereby securing stable wearing of the above protective equipment on a wearer's head, and preventing biasing thereof. The cushion pad structure comprises a cushion pad which has a plurality of slip-prevention pieces formed at an inner peripheral surface thereof, and a groove defined at an outer peripheral surface thereof, and a fixing clip which is configured to be engaged in the groove of the cushion pad, and has upper and lower U-shaped fastening pieces formed at both lateral ends thereof. The fixing clip is formed, using an injection molding process, such that it is integral with the cushion pad.

6 Claims, 5 Drawing Sheets

(a)

(b)

CUSHION PAD STRUCTURE FOR HEADBAND

BACKGROUND OF THE INVENTION

1. Field of the Invention

The present invention relates to a cushion pad structure for a headband, and more particularly to a cushion pad structure, which is coupled to a headband as an integral component of safety hats, protective masks, and the like, so as to maintain uniform balance of the headband, thereby securing stable wearing of the above protective equipment on a wearer's head, and preventing biasing thereof.

2. Description of the Related Art

To the inside of protective equipment, such as a safety hat or welding mask, is integrally fixed a headband for securing stable wearing of the protective equipment on a wearer's head.

Such a headband comprises a clamp member configured to surround the circumference of the wearer's head, and a support member to be located on the vertex of the wearer's head. The clamp member and support member are integrally coupled to each other, and are freely adjustable in their size, especially, diameters.

In addition to the above members, the headband also comprises a sponge sheet, which is integrally added to a front portion of the clamp member, and is adapted to absorb sweat dripping down to the wearer's face while working and thus prevent the sweat from entering the wearer's eyes.

Although the sponge sheet is integrated to the front portion of the clamp member, a rear portion of the clamp member is simply made of hard synthetic resin materials without such a sponge sheet since it is free from the effects of sweat, etc.

Such a configuration, wherein only to the front portion of the clamp member is added the sponge sheet, makes it difficult to maintain the proper balance of the clamp member, and causes friction between the wearer's hair and the clamp member, thereby causing disadvantageous biasing of a safety hat. This results in serious difficulties in work.

Moreover, since the clamp member and support member of the headband are configured so that they come into close contact with the wearer's head so as not to allow inflow of outside air, in case of using the safety hat, in hot weather during summer, it is inconvenient in use since a wearer has to frequently take off it in order to remove sweat.

SUMMARY OF THE INVENTION

Therefore, the present invention has been made in view of the above problems, and it is an object of the present invention to provide a soft pad structure for a headband, which is added to a rear portion of the adjustable headband so as to maintain the uniform balance of the headband, thereby securing stable and convenient wearing of protective equipment, such as a safety hat, on a wearer's head.

In accordance with a first aspect of the present invention, the above and other objects can be accomplished by the provision of a cushion pad structure for a headband comprising: a cushion pad having a plurality of slip-prevention pieces formed at an inner peripheral surface thereof, and a groove defined at an outer peripheral surface thereof; and a fixing clip configured to be engaged in the groove of the cushion pad, and having upper and lower U-shaped fastening pieces formed at both lateral ends thereof, wherein the fixing clip is formed, using an injection molding process, such that it is integral with the cushion pad.

In accordance with a second aspect of the present invention, the above and other objects can be accomplished by the provision of a cushion pad structure for a headband comprising: a cushion pad having a plurality of protrusions formed at an inner peripheral surface thereof; and a fixing clip having a plurality of through holes, and upper and lower U-shaped fastening pieces formed at both lateral ends thereof, whereby, as the through holes are engaged with the protrusions, the cushion pad is coupled to a clamp member of the headband by the fixing clip.

In accordance with a third aspect of the present invention, the above and other objects can be accomplished by the provision of a cushion pad structure for a headband comprising: a cushion pad having a plurality of slip-prevention pieces formed at an inner peripheral surface thereof, and a plurality of protruding pieces formed inside a groove defined at an outer peripheral surface thereof; and a fixing clip having a plurality of through holes, and upper and lower U-shaped fastening pieces formed at both lateral ends thereof, whereby, as the through holes are engaged with the protruding pieces, the cushion pad is coupled to a clamp member of the headband via the fixing clip.

Preferably, the upper and lower fastening pieces of the fixing clip may be bent vertically.

In accordance with a fourth aspect of the present invention, the above and other objects can be accomplished by the provision of a cushion pad structure for a headband comprising: a cushion pad having vertically aligned upper and lower fastening slots formed near both lateral ends thereof; and a pair of C-shaped fixing clips configured to be inserted through the fastening slots, so as to couple the cushion pad to a clamp member constituting the headband.

In accordance with a fifth aspect of the present invention, the above and other objects can be accomplished by the provision of a cushion pad structure for a headband comprising: a cushion pad having vertical grooves formed near both lateral ends of an inner peripheral surface thereof; and a pair of C-shaped fixing clips configured to be engaged in the vertical grooves, respectively, so as to couple the cushion pad to a clamp member constituting the headband.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, the general configuration of the present invention and special effects obtained therefrom will be explained in detail with reference to the accompanying drawings.

Figure 1:
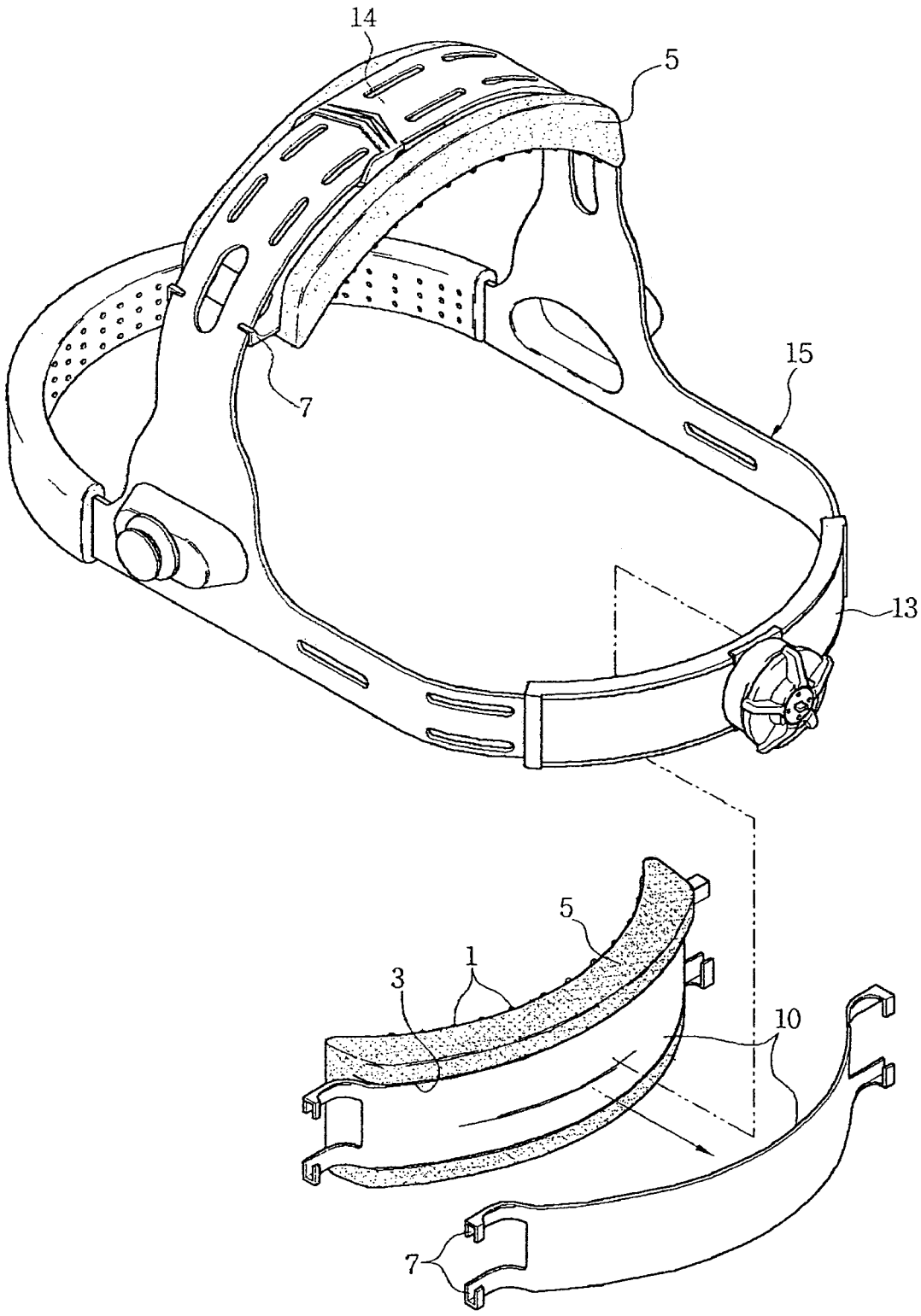
FIG. 1 is a perspective view illustrating the general configuration of a cushion pad structure in accordance with a first embodiment of the present invention.

FIG. 1 is a perspective view illustrating the general configuration of a cushion pad structure in accordance with a first embodiment of the present invention. The cushion pad structure comprises a cushion pad 5, and a fixing clip 10, which is integrally molded to the cushion pad 5, and is adapted to be coupled to an adjustable headband 15.

The cushion pad 5, molded from a soft material, has a plurality of slip-prevention pieces 1, having a constant thickness, formed at an inner peripheral surface thereof, and a groove 3 formed at an outer peripheral surface thereof. Herein, the inner peripheral surface of the cushion pad 5 means a surface coming into contact with the wearer's head, and the outer peripheral surface thereof means a surface to be coupled to the headband 15.

It should be noted that the slip-prevention pieces 1 are variable in shape without being limited to that shown in FIG. 1, and thus may be shaped into vertical or horizontal recesses, or corrugated or crucial portions.

The fixing clip 10, which is configured to be engaged in the groove 3 of the cushion pad 5, is formed, using an injection molding process, such that it is integral with the cushion pad 5. The fixing clip 10 is molded from a thin steel plate or synthetic resins having a high durability and elasticity. Both lateral ends of the fixing clip 10 are cut out in their middle regions, so as to define fastening pieces 7 at their upper and lower edges. Upper ones of the fastening pieces 7 have an inverted U-shaped cross sectional shape, and the other lower ones have a U-shaped cross sectional shape, so as to be coupled to a clamp member 13 constituting the headband 15.

As stated above, the cushion pad 5 and the fixing clip 10 are separately manufactured, and then are formed so as to be integral with each other using an injection molding machine.

In order to couple the cushion pad structure of the present embodiment to the headband 15, the fastening pieces 7, protruding laterally from both the lateral ends of the fixing clip 10, are fitted to upper and lower edges of the clamp member 13, resulting in a firm fixation of the cushion pad structure.

Figure 2:
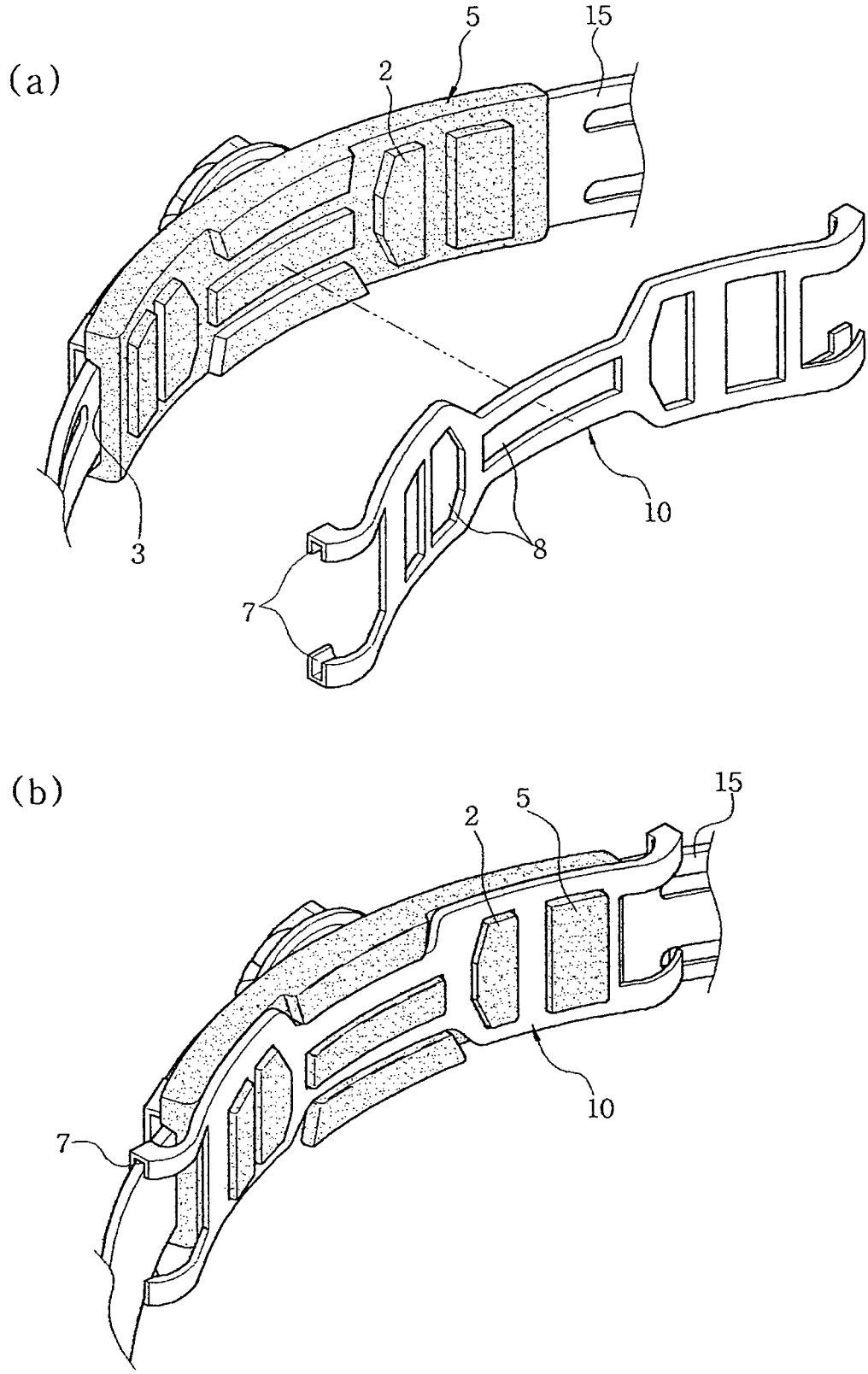
FIG. 2*a* is an exploded perspective view of a cushion pad structure in accordance with a second embodiment of the present invention, wherein a fixing clip is positioned to be coupled to an inner peripheral surface of a cushion pad.
FIG. 2*b* is a perspective view illustrating a coupled state of the cushion pad structure shown in FIG. 2*a;*

FIGS. 2*a* and 2*b* illustrate a cushion pad structure in accordance with a second embodiment of the present invention. In the present embodiment, elements similar to those of the previous embodiment are denoted by the same reference numerals as them. A cushion pad 5 and a fixing clip 10 of the present embodiment are separately formed using an injection molding process, and then are coupled to each other.

Here, the fixing clip 10 is adapted to be coupled to an inner peripheral side of the cushion pad 5.

For this, the cushion pad 5 has a plurality of protrusions 2 formed at the inner peripheral surface thereof, and at an outer peripheral surface of the cushion pad 5 is defined a groove 3. The groove 3 of the cushion pad 5 is configured to receive the clamp member 13 therein.

The fixing clip 10 is formed with a plurality of through holes 8 having the same shape as that of the protrusions 2 formed at the cushion pad 5, and U-shaped fastening pieces 7 at both lateral ends thereof.

With such a configuration, after in the groove 3 defined at the outer peripheral surface of the cushion pad 5 is fitted the clamp member 13, the through holes 8 of the fixing clip 10 are engaged with the protrusions 2 of the cushion pad 5, and then the fastening pieces 7 are fitted to the clamp member 13.

Figure 3:
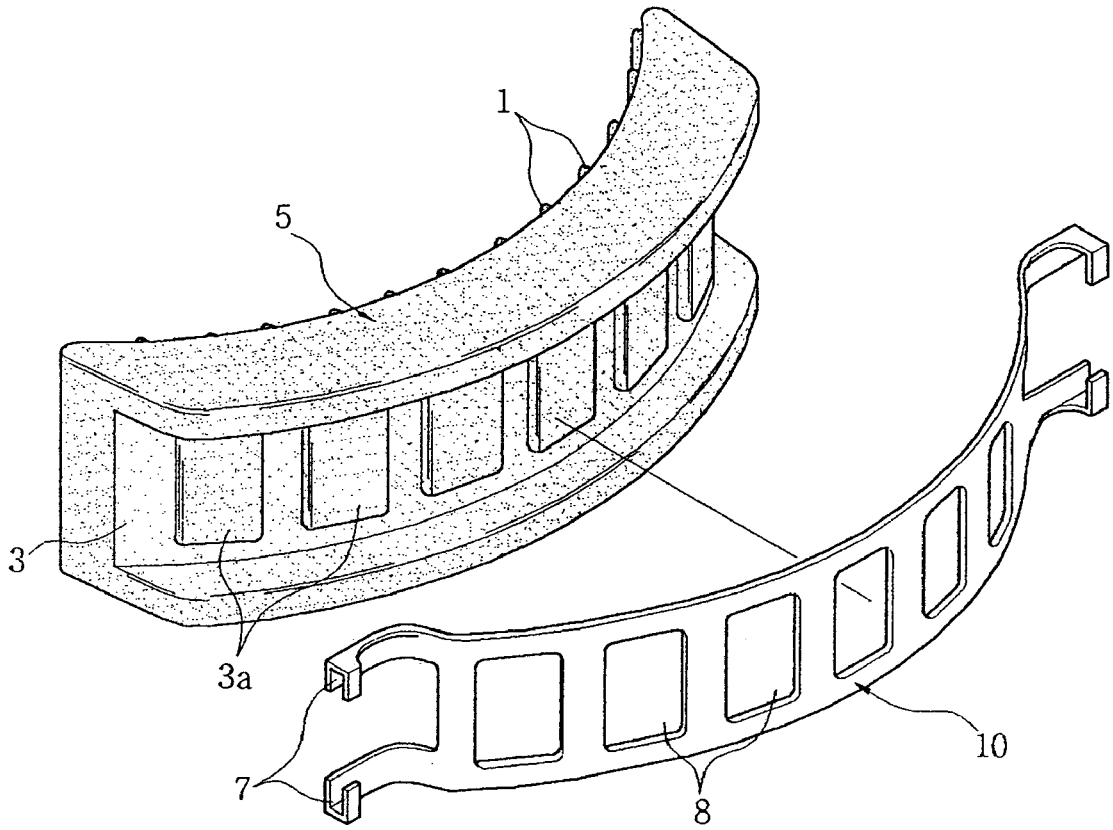
FIG. 3 is an exploded perspective view of a cushion pad structure in accordance with a third embodiment of the present invention, wherein a fixing clip is positioned to be coupled to an outer peripheral surface of a cushion pad.

FIG. 3 illustrates a cushion pad structure in accordance with a third embodiment of the present invention wherein elements similar to those of the previous embodiments are denoted by the same reference numerals as them.

In the present embodiment, a fixing clip 10 is positioned to be coupled to an outer peripheral surface of a cushion pad 5. The cushion pad 5 has a plurality of slip-prevention pieces 1 formed at an inner peripheral surface thereof, and a plurality of protruding pieces 3 formed inside a groove 3 defined at the outer peripheral surface thereof.

The fixing clip 10, to be integrally coupled to the cushion pad 5, has a plurality of through holes 8 having the same shape as that of the protruding pieces 3*a* formed at the cushion pad 5, and U-shaped fastening pieces 7 formed at upper and lower edges of both lateral ends thereof.

The coupling of the cushion pad 5 and fixing clip 10 is performed in the same manner as that of the above second embodiment.

Figure 4:
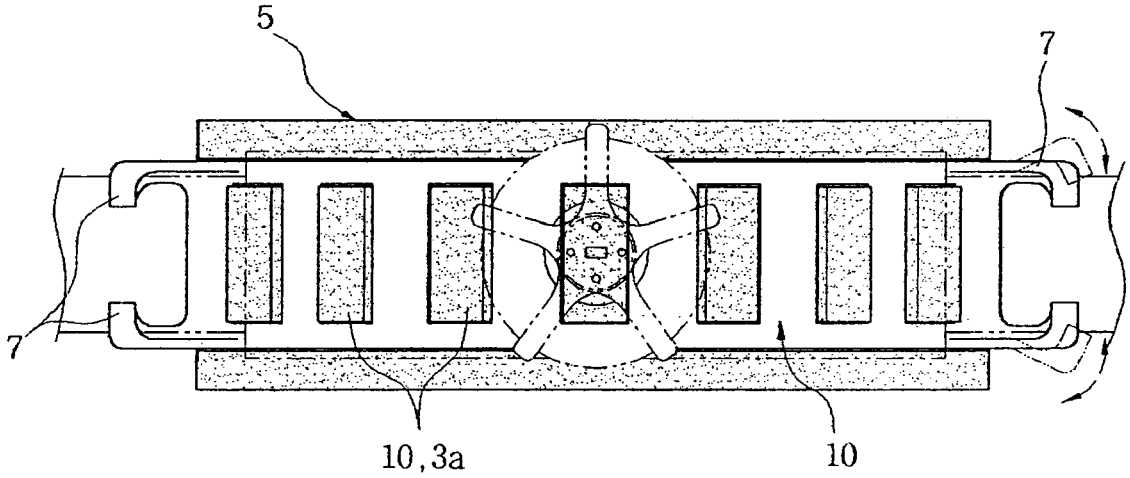
FIG. 4 is a front view illustrating a coupled state of the cushion pad structure shown in FIG. 3.

In order to be fitted to the clamp member 13, the fixing clip 10 can be elastically deformed as shown in FIG. 4.

That is, in a state wherein the fixing clip 10 has a plurality of the through holes 8, and the fastening pieces 7 are integrally formed at the upper and lower edges of both the lateral ends of the fixing clip 10, the upper and lower fastening pieces 7 are vertically bent by virtue of their elasticity, thereby allowing the fixing clip 10 to be coupled to the clamp member 13 with a good coupling efficiency equal to that of the previous embodiments.

Figure 5:
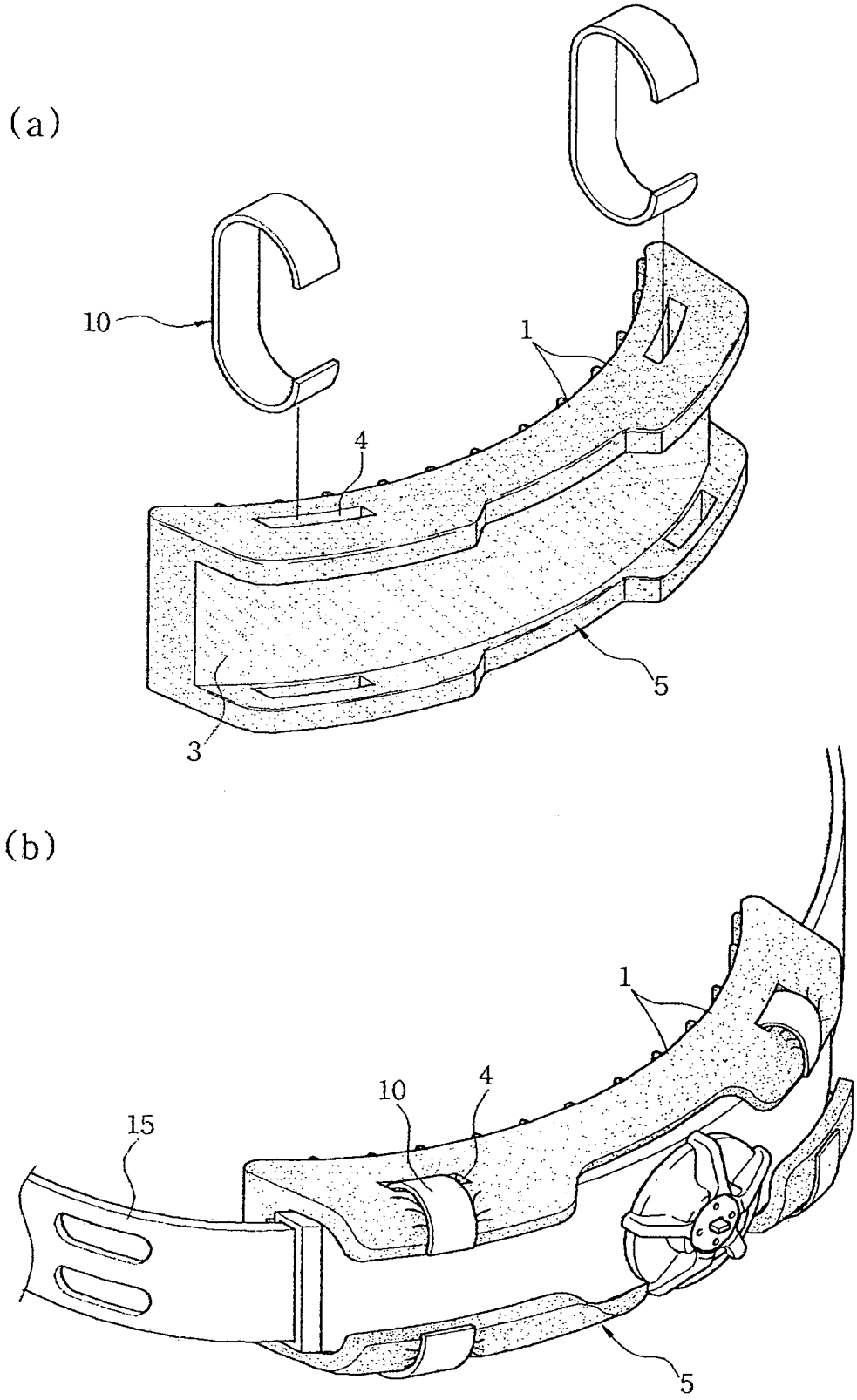
FIG. 5*a* is an exploded perspective view of a cushion pad structure in accordance with a fourth embodiment of the present invention, wherein a cushion pad is configured to be coupled by means of C-shaped fixing clips.
FIG. 5*b* is a perspective view illustrating a coupled state of the cushion pad structure shown in FIG. 5*a;*

FIGS. 5*a* and 5*b* illustrate a cushion pad structure in accordance with a fourth embodiment of the present invention. In the present embodiment, elements similar to those of the previous embodiments are denoted by the same reference numerals as them. A cushion pad 5 of the present embodiment is formed with upper and lower fastening slots 4 near both lateral ends thereof, whereas a pair of fixing clips 10 are configured to be inserted through the upper and lower fastening slots 4, so as to integrally couple the cushion pad 5 to the clamp member 13.

After the fixing clips 10 are inserted through the vertically aligned upper and lower fastening slots 4 formed at both the lateral ends of the cushion pad 5, a resultant cushion pad structure can be integrally coupled to the clamp member 13.

The fixing clips 10 are formed to have an approximately C-shape, and have elasticity suitable for integrally coupling the cushion pad 5 to the clamp member 13.

Figure 6:
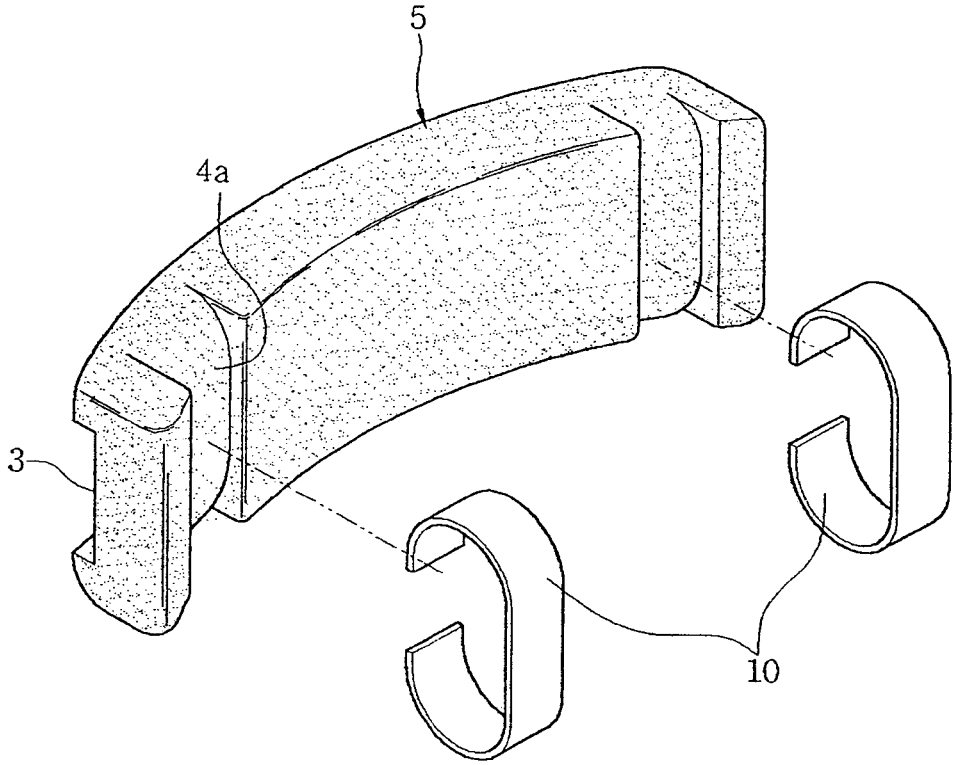
FIG. 6*a* is an exploded perspective view illustrating a cushion pad structure in accordance with a fifth embodiment of the present invention.
FIG. 6*b* is a perspective view illustrating a coupled state of the cushion pad structure shown in FIG. 6*a*.
Figure 6:
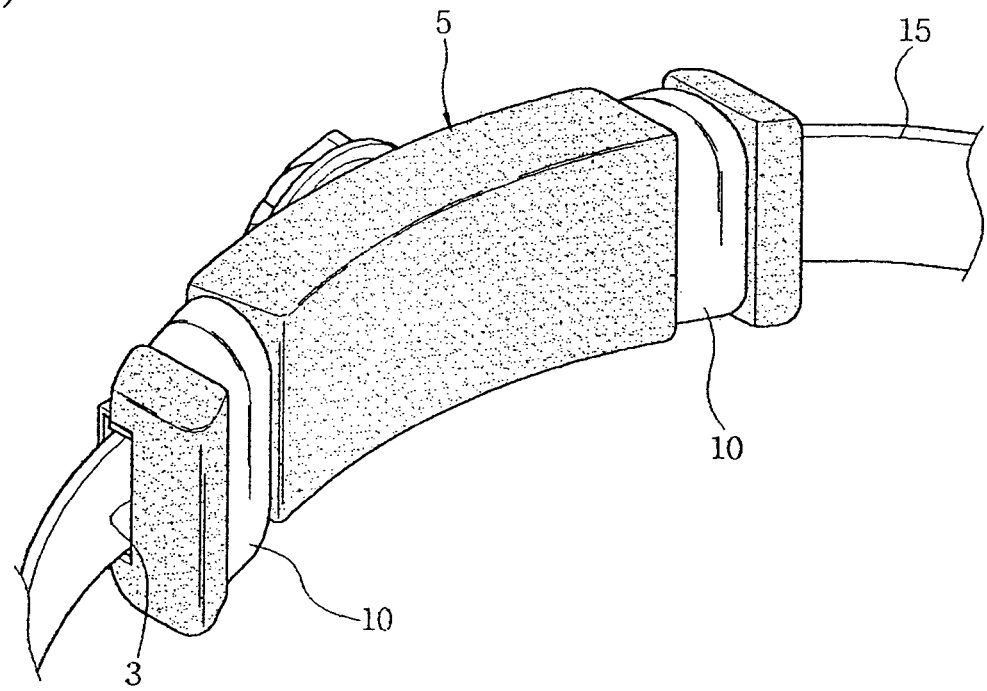

FIGS. 6*a* and 6*b* illustrate a cushion pad structure in accordance with a fifth embodiment of the present invention. The present embodiment is similar to the fourth embodiment except for the fastening slots of the fourth embodiment are substituted for vertical grooves. Therefore, in the present embodiment, elements similar to those of the previous embodiments are denoted by the same reference numerals as them.

As shown in FIGS. 6*a* and 6*b*, a cushion pad 5 is formed at both lateral ends thereof with vertical grooves 4*a*, respectively. As a pair of fixing clips 10 are engaged in the vertical grooves 4*a* of the cushion pad 5, respectively, the cushion pad 5 is integrally coupled to the clamp member 13 with a good coupling efficiency equal to that of the previous embodiments.

Although the foregoing description discloses the cushion pad structure adapted to be coupled to the clamp member 13, the cushion pad structure may be coupled to a support member 14 constituting the headband in the same manner as stated above as operator's demands.

As apparent from the above description, the present invention provides a cushion pad structure which is configured so that a cushion pad thereof is detachably coupled to a clamp member or support member constituting a headband by means of a fixing clip or fixing clips, thereby maintaining the uniform balance of the headband, and securing stable wearing of protective equipment, such as a safety hat or welding mask, on a wearer's head without causing biasing thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cushion pad structure for a headband comprising:

a cushion pad having a plurality of slip-prevention pieces formed at an inner peripheral surface thereof, and a groove defined at an outer peripheral surface thereof; and a fixing clip configured to be engaged in the groove of the cushion pad, and having upper and lower U-shaped fastening pieces formed at both lateral ends thereof, wherein the fixing clip is formed, using an injection molding process, such that it is integral with the cushion pad.

2. A cushion pad structure for a headband comprising:

a cushion pad having a plurality of protrusions formed at an inner peripheral surface thereof; and a fixing clip having a plurality of through holes, and upper and lower U-shaped fastening pieces formed at both lateral ends thereof, whereby, as the through holes are engaged with the protrusions, the cushion pad is coupled to a clamp member of the headband by the fixing clip.

3. A cushion pad structure for a headband comprising:

a cushion pad having a plurality of slip-prevention pieces formed at an inner peripheral surface thereof, and a plurality of protruding pieces formed inside a groove defined at an outer peripheral surface thereof; and a fixing clip having a plurality of through holes, and upper and lower U-shaped fastening pieces formed at both lateral ends thereof, whereby, as the through holes are engaged with the protruding pieces, the cushion pad is coupled to a clamp member of the headband via the fixing clip.

4. The structure as set forth in claim 3, wherein the upper and lower fastening pieces of the fixing clip are bent vertically.

5. A cushion pad structure for a headband comprising:

a cushion pad having vertically aligned upper and lower fastening slots formed near both lateral ends thereof; and a pair of C-shaped fixing clips configured to be inserted through the fastening slots, so as to couple the cushion pad to a clamp member constituting the headband.

6. A cushion pad structure for a headband comprising:

a cushion pad having vertical grooves formed near both lateral ends of an inner peripheral surface thereof; and a pair of C-shaped fixing clips configured to be engaged in the vertical grooves, respectively, so as to couple the cushion pad to a clamp member constituting the headband.

* * * * *